US005146717A

United States Patent [19]

Shemesh et al.

[11] Patent Number: 5,146,717

[45] Date of Patent: Sep. 15, 1992

[54] ROTATING TOOL

[76] Inventors: Josef Shemesh, 8560 Caversham Court, Vancouver, B.C., Canada, V6P 6R8; William Z. Gelbart, 2284 Allison Drive, Vancouver, B.C., Canada, V6T 1T8

[21] Appl. No.: 801,864

[22] Filed: Dec. 3, 1991

[51] Int. Cl.[5] ..... B24D 15/04

[52] U.S. Cl. ..... 51/392; 51/360; 51/361; 51/205 R; 51/205 WG; 15/104.04

[58] Field of Search ..... 51/358, 359, 360, 361, 51/362, 391, 392, 204, 205 R, 205 WG, 364, 370, 367, 368; 30/94-98; 15/104.04

[56] References Cited

U.S. PATENT DOCUMENTS

| | | | |
|---|---|---|---|
| Re. 26,039 | 6/1966 | Johnson | 51/392 |
| 1,025,859 | 5/1912 | Calahan | 51/361 |
| 1,748,313 | 2/1930 | Steuber . | |
| 1,905,821 | 4/1933 | Dunbar | 51/361 |
| 1,908,048 | 5/1933 | Player | 51/361 |
| 1,946,562 | 2/1934 | Wurfschmidt | 51/137 |
| 2,469,586 | 5/1949 | Wallace | 51/184.1 |
| 2,566,434 | 9/1951 | Toth | 30/94 |
| 2,618,915 | 11/1952 | Johnson | 51/360 |
| 3,375,618 | 4/1968 | Charniga | 51/391 |
| 3,380,202 | 4/1968 | Hartinger | 51/364 |
| 3,568,376 | 5/1968 | Slater | 51/241 |
| 3,673,747 | 7/1972 | Pass | 51/370 |
| 4,472,877 | 9/1984 | Undin | 30/96 |
| 4,790,121 | 12/1988 | Roberts | 51/205 R |

*Primary Examiner*—Bruce M. Kisliuk
*Assistant Examiner*—Jack Lavinder
*Attorney, Agent, or Firm*—Fetherstonhaugh & Company

[57] ABSTRACT

A hand tool for treating the outside surface of a cylindrical component such as a pipe or tube grips the outside surface and can be rotated by inserting a finger into a finger engagement and spinning the tool about the component. Plumbers and the like clean the outside surface of pipes by using abrasive cloth, and the hand tool provides a tool for treating the surface with less effort. The hand tool has a lower body with a pivot adjacent one end and a treatment surface adjacent the other end, the lower body has a finger engagement adjacent the one end to rotate the tool about the component. A top body has a spring to join the lower body allowing the top body to pivot, and has a guide position to guide the component in contact with the treatment surface, the spring applies a force between the component and the treatment surface as the tool is rotated.

6 Claims, 1 Drawing Sheet

ROTATING TOOL

TECHNICAL FIELD

The present invention relates to a hand tool for treating peripheral exterior surfaces of a cylindrical component. More specifically, a hand tool is disclosed having a treatment surface that may be rotated about a cylindrical component to treat a peripheral surface. By treatment includes abrasive treatment to sand or reduce the diameter of the cylindrical component. Alternatively, the end of the component may be deburred, particularly if it is a tube or a groove may be cut into the peripheral surface.

BACKGROUND ART

Copper pipes used in plumbing generally have soldered fittings and it is necessary to clean the peripheral exterior surfaces of the pipes prior to soldering the pipe into the fitting. The surface of the pipe is generally cleaned by means of an abrasive cloth or sandpaper to ensure proper solder wetting and avoid dry joints. At the present time this is generally done by holding a strip or sheet of abrasive cloth, holding the pipe and moving the strip about the peripheral surface. Such an operation is time consuming and also difficult as one must not only hold the strip but also apply pressure to ensure that the abrasive surface presses against the peripheral surface of the tube or pipe.

DISCLOSURE OF INVENTION

It is an aim of the present invention to provide a hand tool which has a treatment surface such as an abrasive surface, the hand tool being able to grip a peripheral surface of a cylindrical component such as a tube or pipe. The tool has a finger engagement hole into which a finger can be inserted so that the tool can be easily rotated or spun about the pipe, and in this manner, the treatment surface treats the peripheral surface of the pipe. The tool does not require that one holds abrasive material directly onto the tube or pipe because a spring action in the tool causes the pipe to be pushed against an abrasive surface. The finger action provides an easy movement for rotating or spinning the tool about the pipe.

Furthermore, the hand tool of the present invention may be adapted for a number of uses including cutting a groove on the exterior peripheral surface of a cylindrical component such as a tube, pipe or other type of cylinder. Different materials may be used, plastic, copper, or other metal tubes or pipes. The device may be used for deburring the end of a cylindrical component such as a tube or pipe, and a positioning adaptor is provided so that the location of the groove or the location of the treating surface is determined on the peripheral surface of the cylindrical component.

The present invention provides a hand tool for finishing an exterior periphery of a cylindrical component comprising a lower body having a pivot means adjacent one end and a treatment surface adjacent the other end, the lower body having means for finger engagement adjacent the one end to rotate the hand tool about the cylindrical component, a top body having spring means joining to the lower body, adapted to pivot at the pivot means, and having guide means to guide the cylindrical component in contact with the treatment surface, the spring means adapted to apply force between the cylindrical component and the treatment surface as the hand tool is rotated.

BRIEF DESCRIPTION OF DRAWINGS

In drawings which illustrate embodiments of the invention.

MODES FOR CARRYING OUT THE INVENTION

Figure 1:
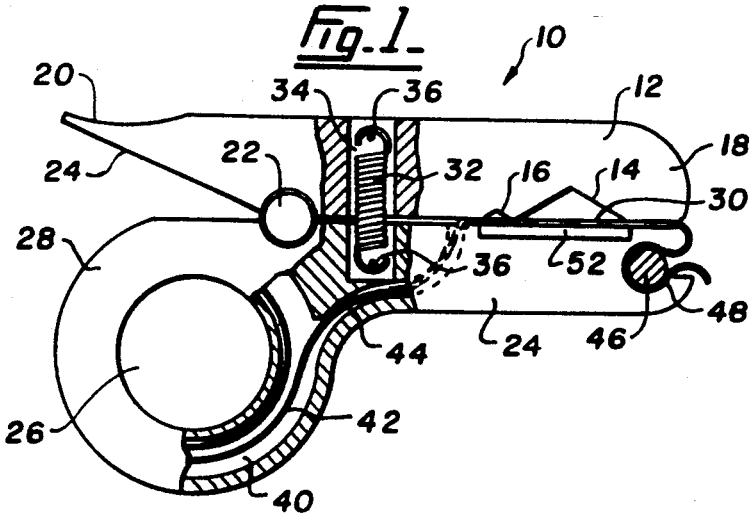
FIG. 1 is an elevational view partly in section showing a hand tool according to one embodiment of the present invention.

The hand tool 10 shown in FIG. 1 has an upper body 12 which is elongated and has a large V-shaped pipe guide 14 and a small V-shaped pipe guide 16 adjacent one end 18. At the other end 20 of the upper body 12, a pivot pin 22 is provided and an angular face 24 extends away from the pivot 22 towards the end 20.

A lower body 24 has an index finger hole 26 within a ring 28 at an end adjacent the pivot 22. There is provided a treatment surface 30 adjacent the other end of the lower body 24 positioned opposite to the two V-shaped guides 14 and 16. A coiled spring 32 is provided in a hole 34 passing from the upper body 12 to the lower body 24 and pins 36 hold the spring 32 in place. By pressing on the end 20 of the upper body 12, the upper body pivots about pivot 22 to open a space that will permit a cylindrical component to be inserted in one or other of the V-shaped guides 14 and 16. By releasing the end 20 of the upper body 12 the upper body closes to guide a cylindrical component to press against the treatment surface 30.

Figure 2:
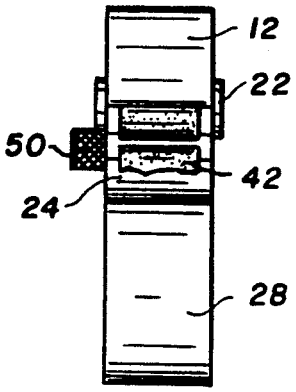
FIG. 2 is an end view of FIG. 1.

In the embodiment shown, a hollow cylindrical core 40 contains a coiled abrasive strip 42 which passes through channel 44 over treatment surface 30 and around an advancing pin 46 which rotates in an aperture 48 at the end of the lower body 24. A knurled knob 50 shown in FIG. 2 allows the pin 46 to be rotated and the pin grips the abrasive strip 42 and feeds it over the treatment surface 30. Thus, the abrasive strip 42 is advanced when the abrasive surface wears.

The treatment surface 30 has a resilient pad 52 preferably made of flexible foam rubber, or other suitable material, beneath the treatment surface 30. This provides a more even pressure to be applied on a cylindrical component when it is being treated.

Figure 3:
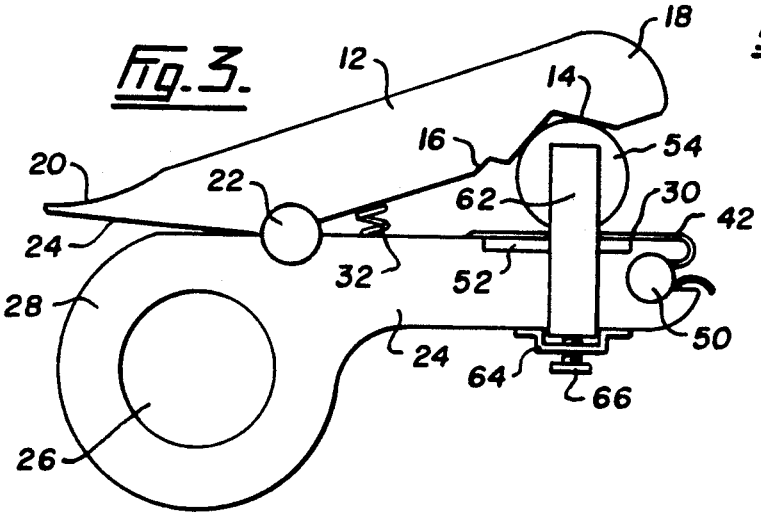
FIG. 3 is an elevational view of another embodiment of a hand tool according to the present invention having a cylindrical component therein.

FIG. 3 illustrates one embodiment of the hand tool having a cylindrical component 54 gripped between the upper body 12 and the lower body 24 with the V-shaped guide 14 ensuring that the component 54 is forced against the treatment surface 30. An index finger is passed into ring 26 and the tool 10 spun around the cylindrical component 54. The treatment surface 30 acts on the exterior peripheral surface of the cylindrical component 54 to either clean, polish or in other fashion treat the peripheral surface.

Figure 4:
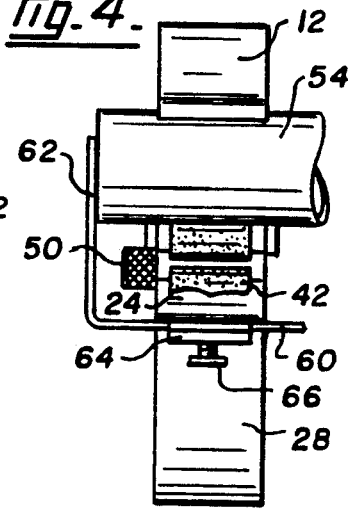
FIG. 4 is an end view of the hand tool shown in FIG. 3.

A positioning arm 60 is illustrated in FIGS. 3 and 4. The arm is L-shaped having an end 62 for locating against an end of the cylindrical component 54. A guide 64 is provided underneath the lower body 24 and a knurled screw 66 allows for tightening the positioning arm 60 so that a preset distance for insertion of the cylindrical component 54 through the hand tool 10 is obtained. Thus, a particular surface on the cylindrical component 54 may be treated.

Figure 5:
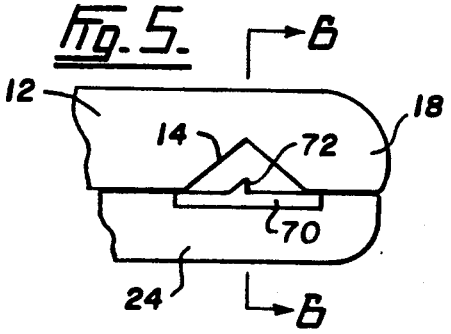
FIG. 5 is a partial elevational view showing another embodiment of a treatment surface for a hand tool of the present invention.
Figure 6:
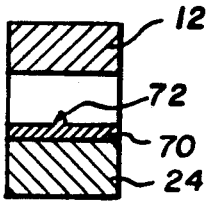
FIG. 6 is a sectional view taken at line 6—6.
Figure 7:
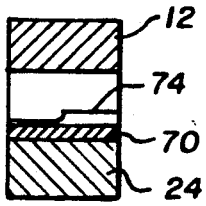
FIG. 7 is a sectional view taken at line 6—6 showing another embodiment of a treatment surface.

FIGS. 5, 6 and 7 show other embodiments wherein the strip of abrasive material is removed and the treatment surface 30 is provided by an insert 70 which in the case of FIG. 6 is a V-form 72 providing a groove that can be cut into the exterior peripheral surface of a cylindrical component 54. The insert 70 is preferably made from tool steel or other suitable material and no resilient pad 52 is provided as shown in FIGS. 1 and 3. FIG. 7 illustrates another embodiment wherein the insert 70 has a shoulder 74 that is provided for removing burrs from the end of a tube or other cylindrical component. By rotating the tool about the end of a tube, the burrs are removed and if necessary a radiused end may be provided.

In other embodiments incorporation of a solid or liquid container may be provided above the upper body 12 for providing lubrication, particularly in the case of cutting a groove in the exterior peripheral surface of a tube.

The operation of pivoting the upper body 12 relative to the lower body 24 is similar to that of a clothes pin. The materials of construction may be wood, plastic, metal, or other suitable material.

Various changes may be made to the embodiments shown herein without departing from the scope of the present invention which is limited only by the following claims.

The embodiments of the present invention in which an exclusive property or privilege is claimed are defined as follows:

1. A hand tool for finishing exterior peripheries of cylindrical components of variable diameters comprising:

a lower body having a pivot means adjacent one end and an abrasive strip located on a planar flexible backing member adjacent the other end, the lower body having a ring integral therewith adjacent the one end, the ring having an aperture for finger insertion, adapted to rotate the hand tool about the cylindrical component;

a top body having spring means joining to the lower body, adapted to pivot at the pivot means, and having guide means to guide the cylindrical component in contact with the abrasive strip on the planar flexible backing member, the spring means adapted to apply force between the cylindrical component and the abrasive strip on the planar flexible backing member as the hand tool is rotated.

2. The hand tool according to claim 1 wherein the abrasive strip extends beyond the flexible backing and has advance means to permit the abrasive strip to be advanced as the abrasive strip wears.

3. The hand tool according to claim 2 wherein the advance means includes a shaft rotatable in an aperture, the abrasive strip passing around the outside of the shaft in the aperture, rotation of the shaft advancing the abrasive strip.

4. The hand tool according to claim 1 wherein the flexible backing is foam plastic.

5. The hand tool according to claim 1 wherein a coil of the abrasive strip fits in a cylindrical chamber in the ring, and including a passageway to feed the abrasive strip from the cylindrical member over the flexible backing, and including means to advance the abrasive strip to pass over the flexible backing.

6. The hand tool according to claim 1 wherein the spring means comprises a coiled spring fitting into adjacent cavities in the lower body and the top body.

* * * * *